US012716670B2

(12) United States Patent
Meidinger

(10) Patent No.: US 12,716,670 B2
(45) Date of Patent: Aug. 25, 2026

(54) ADJUSTABLE GAS SYSTEM

(71) Applicant: Faxon Firearms, LLC, Fairfield, OH (US)

(72) Inventor: Aaron Meidinger, Batavia, OH (US)

(73) Assignee: Faxon Firearms, LLC, Fairfield, OH (US)

( * ) Notice: Subject to any disclaimer, the term of this patent is extended or adjusted under 35 U.S.C. 154(b) by 0 days.

(21) Appl. No.: 19/010,306

(22) Filed: Jan. 6, 2025

(65) Prior Publication Data

US 2025/0277639 A1 Sep. 4, 2025

Related U.S. Application Data

(60) Provisional application No. 63/560,964, filed on Mar. 4, 2024.

(51) Int. Cl.
*F41A 5/24* (2006.01)

(52) U.S. Cl.
CPC ..... *F41A 5/24* (2013.01)

(58) Field of Classification Search
CPC ..... F41A 5/18; F41A 5/24; F41A 5/26; F41A 5/28
See application file for complete search history.

(56) References Cited

U.S. PATENT DOCUMENTS 2,137,612 A * 11/1938 Higson ..... F41F 1/10 89/193
8,960,069 B1 * 2/2015 Soong ..... F41A 5/28 89/193
8,973,483 B2 * 3/2015 Sullivan ..... F41A 3/26 89/193
9,523,543 B1 * 12/2016 Brown ..... F41A 5/26
10,876,805 B1 * 12/2020 Oglesby ..... F41A 5/26
11,287,201 B1 * 3/2022 Underwood ..... F41A 5/26
2010/0186582 A1 * 7/2010 Juarez ..... F41A 5/28 89/191.01
2012/0137872 A1 * 6/2012 Crommett ..... F41A 5/28 89/193
2012/0152106 A1 * 6/2012 Langevin ..... F41A 5/26 89/193
2013/0098235 A1 * 4/2013 Reinken ..... F41A 5/28 89/193
2014/0076149 A1 * 3/2014 Adams ..... F41A 5/28 89/192
2014/0076150 A1 * 3/2014 Brinkmeyer ..... F41A 5/28 89/193
2016/0161200 A1 * 6/2016 Windauer ..... F41A 5/28 89/193
2019/0041147 A1 * 2/2019 Gardner ..... F41A 5/28
2024/0288237 A1 * 8/2024 Gangl ..... F41A 5/28
2025/0277639 A1 * 9/2025 Meidinger ..... F41A 5/24

FOREIGN PATENT DOCUMENTS

WO WO-2012034711 A1 * 3/2012 ..... F41A 3/62

* cited by examiner

*Primary Examiner* — Gabriel J. Klein
(74) *Attorney, Agent, or Firm* — Wood Herron & Evans LLP

(57) ABSTRACT

Disclosed is a firearm gas system including a gas block having a body with gas passageway for alignment with a barrel gas port. A gas tube has a gas inlet in a forward portion thereof and is axially variably positionable in at least partial alignment and disalignment relative to the gas passageway to thereby adjust gas flow.

21 Claims, 7 Drawing Sheets

ADJUSTABLE GAS SYSTEM

RELATED APPLICATIONS

This application claims priority to U.S. Provisional Patent Application No. 63/560,964, filed Mar. 4, 2024, and incorporates the same herein by reference.

TECHNICAL FIELD

This invention relates to an adjustable gas system for a gas-operated auto-loading firearm. In particular, it relates to such a system that is user-adjustable at the gas block and which changes the axial position of the gas tube.

BACKGROUND

Gas-operated firearms use a portion of the expanding propellant gas ported from the bore of the barrel through a gas block and a gas tube to cycle the action, either by direct impingement to a piston within the bolt carrier or by action of an external gas piston. Such systems are well known in the field.

For a given caliber of ammunition, the gas pressure and flow volume ported from the barrel through the gas block can vary significantly depending on the amount/type of propellant and weight of the projectile selected. Thus, it is at times desirable to be able to adjust the pressure and flow of gas ported from the barrel. Many others have provided flow adjustment mechanisms for a firearm gas operating system, including adjustments located in the gas block. Some of these mechanisms are complicated and costly to manufacture. Others provide only a limited number of discrete settings.

SUMMARY OF THE INVENTION

The present invention provides a system for adjusting the gas flow in a gas-operated self-loading firearm. The firearm gas system includes a gas block having a body with gas passageway for alignment with a barrel gas port and a gas tube having a gas inlet in a forward portion thereof. The gas tube is axially variably positionable in at least partial alignment and disalignment relative to the gas passageway to thereby adjust gas flow.

In a firearm, the system includes a barrel with an axial bore and a gas port that vents a portion of the propulsion gas pressure to a gas block and through a gas tube to the gas key of a bolt carrier. Gas flows through a gas passageway in the gas block and into an opening of the gas tube that is adjustably aligned with the passageway. The flow of gas is adjusted by longitudinal movement of the gas tube relative to the gas block, with operates to partially disalign the openings, thereby adjusting the cross-sectional size of the opening through with the gas can flow.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
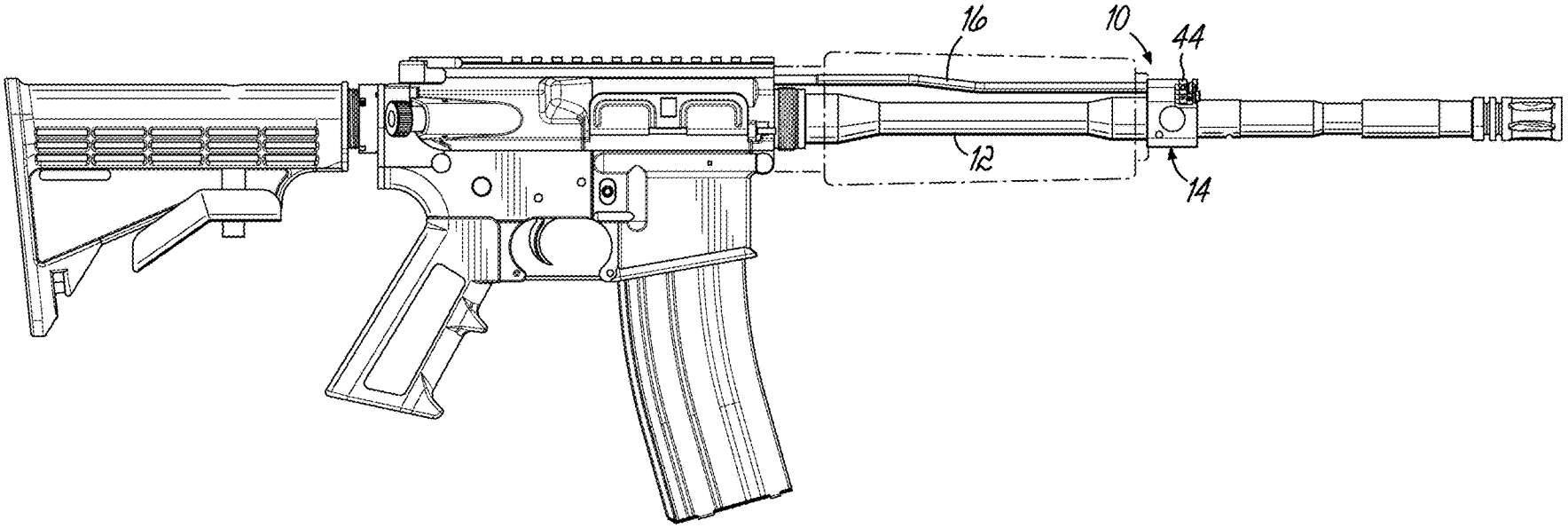
FIG. 1 is a side view of a semiautomatic firearm (in this case, an AR-pattern rifle) including an embodiment of the present invention with the handguard shown in phantom for clarity.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" or "aft" will indicate the opposite direction. "Longitudinal" indicates a direction substantially parallel to the axis of the barrel along the length of the firearm. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 1A:
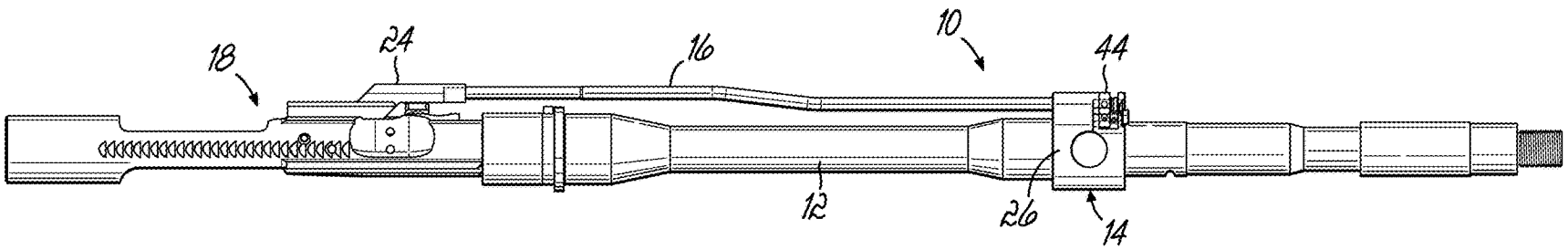
FIG. 1A is a side elevation view of a semiautomatic firearm barrel and bolt carrier group with a gas tube and gas block according to one embodiment of the present invention.
Figure 1B:
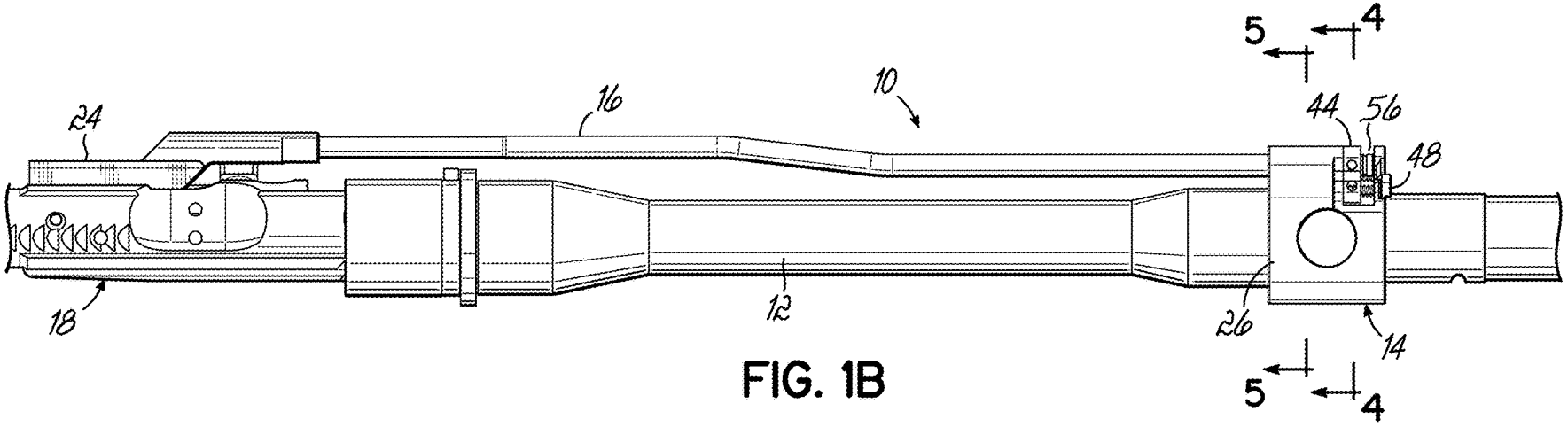
FIG. 1B is an enlarged midportion view thereof.
Figure 2:
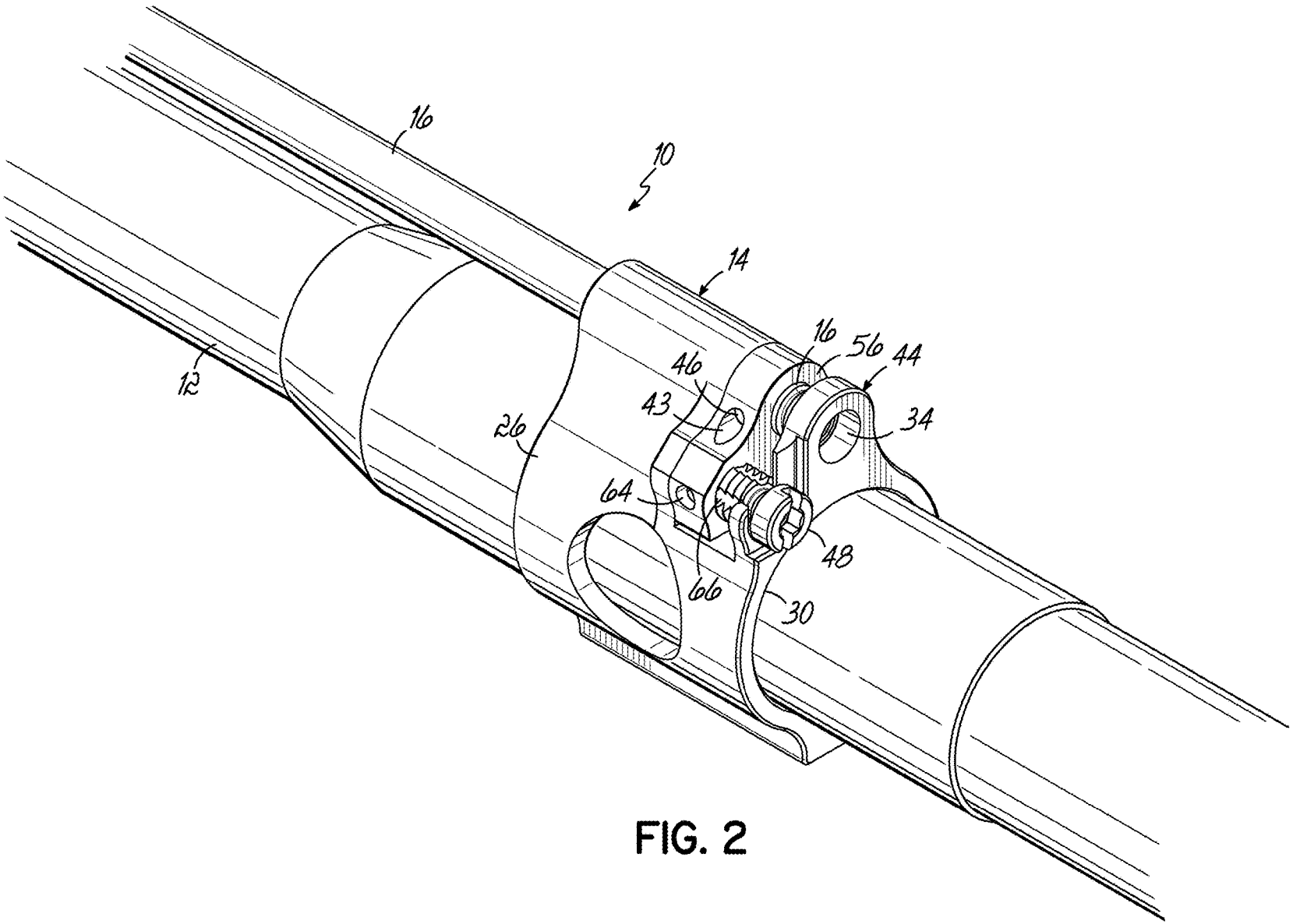
FIG. 2 is an enlarged isometric view of the gas block and portion of the gas tube and barrel.
Figure 3:
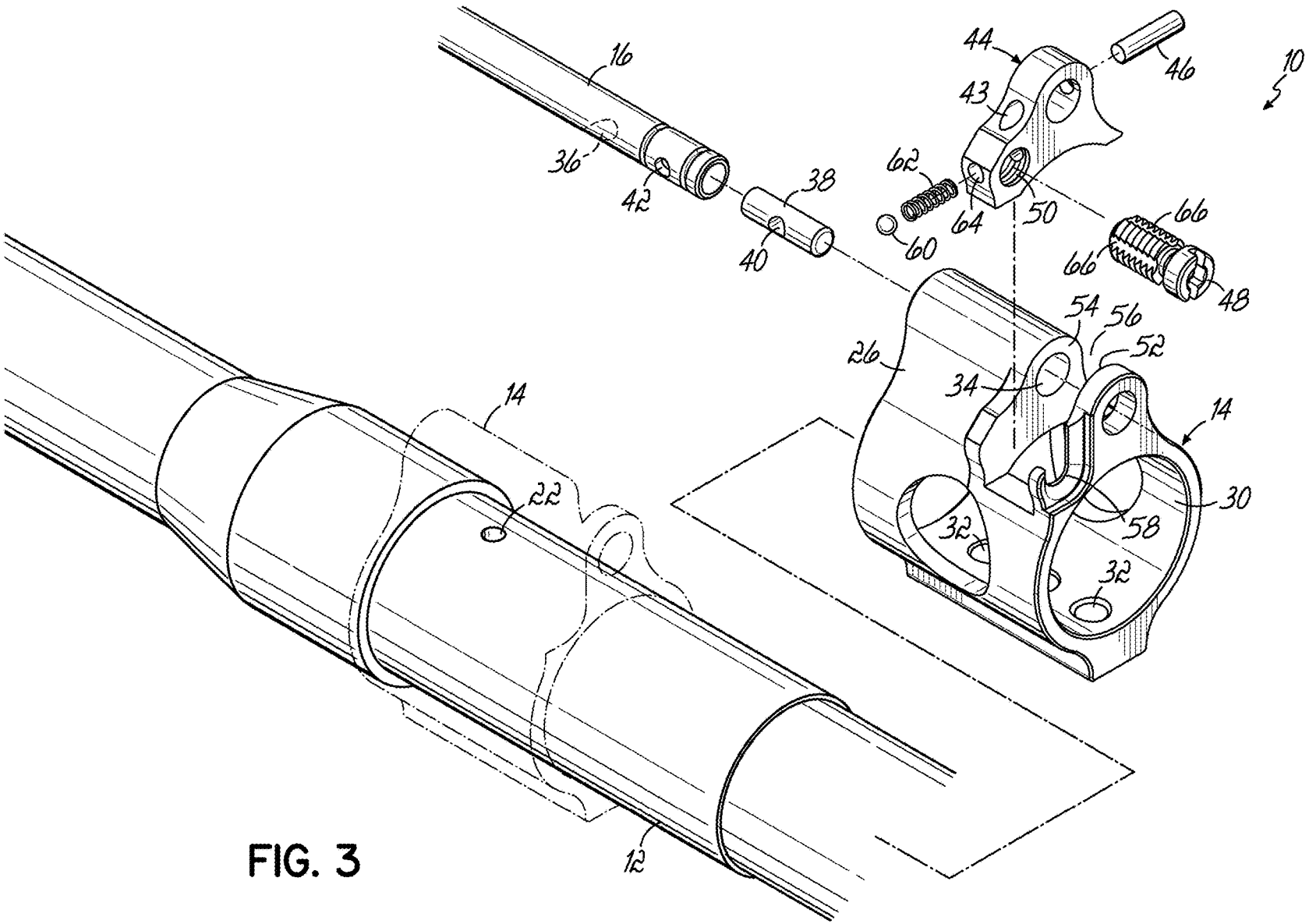
FIG. 3 is an exploded isometric view thereof.
Figure 5:
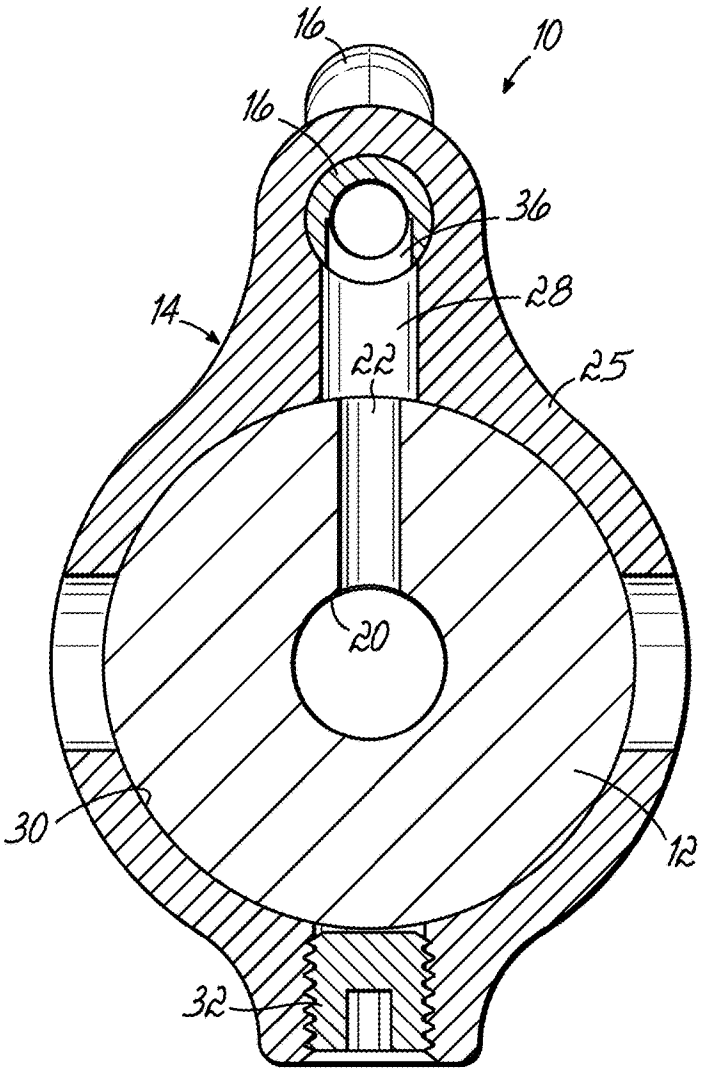
FIG. 5 is a cross-sectional view taken substantially along line 5-5 of FIG. 1B.
Figure 4:
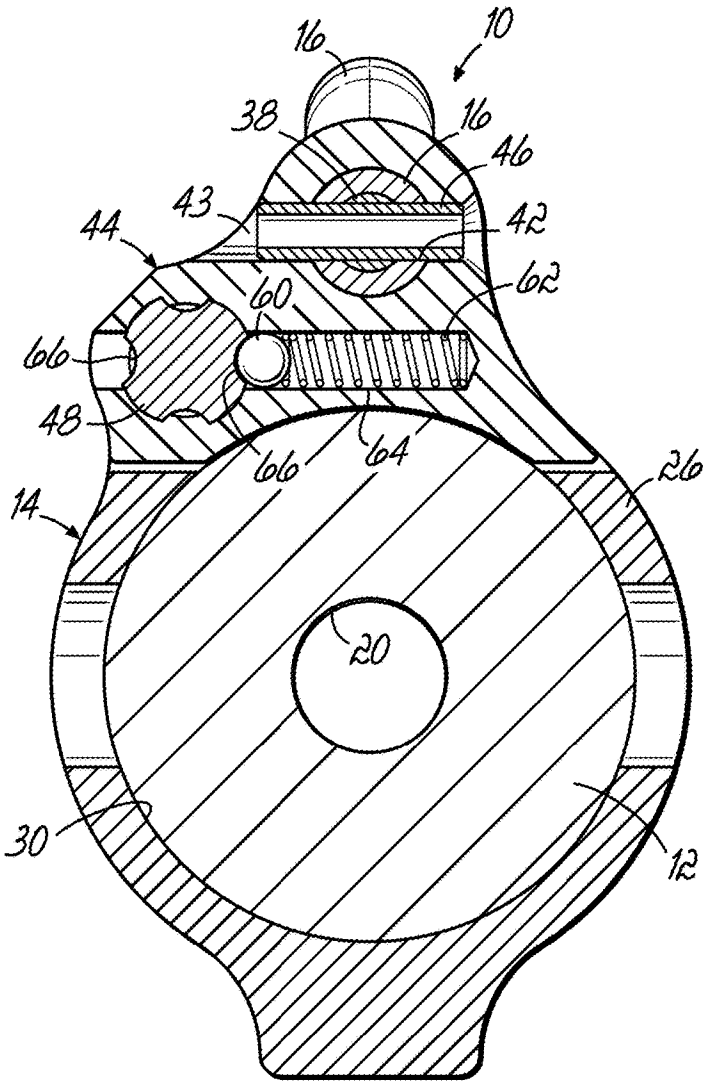
FIG. 4 is a cross-sectional view taken substantially along line 4-4 of FIG. 1B.

Referring first to FIGS. 1, 1A, and 1B, therein is shown the gas system 10 of a typical AR-pattern firearm. The gas system 10 includes a barrel 12, a gas block 14, a gas tube 16, and a bolt carrier group 18. When the gas block body 26 is mounted on the barrel 12, a gas passageway 28 is aligned with the barrel's gas port 22. The illustrated embodiment is an internal piston (direct impingement) system in which gas pressure is delivered from the bore 20 of the barrel 12, through a gas port 22, through the gas block 14, through the gas tube 16, into the gas key 24 of the bolt carrier 18, and into an internal cylinder where it acts against a piston head surface formed on the bolt to unlock the bolt and cycle the bolt carrier group to the rear in a well-known manner.

Referring now also to FIGS. 2-5, the gas block 14 includes a body 26 with a primary bore 30 sized for mounting on a firearm barrel 12. As is well known in the field, the gas block body 26 may be secured to the barrel 12 using threaded set screws 32, for example, clamping (not shown), or other well-known means. Fluid communication with the barrel bore 20 is provided through a barrel port 22 aligned with a substantially radial gas passageway 28 in the gas block body 26. The gas block body 26 includes a second longitudinal bore 34 that may be substantially parallel to the primary bore 30 for slidably receiving a forward portion of the gas tube 16. In the illustrated embodiment, a gas tube 16 includes an inlet 36 in a sidewall and an end plug 38 with a cross bore 40 aligned with opposed openings 42 near the forward end of the gas tube 16. The gas tube 16 is secured to a carrier block 44 with a pin 46 and, as described below, is longitudinally, selectably adjustable in position (along with the gas tube 16) relative to the gas block body 26. A pin 46 inserted through another cross bore 43 in carrier block 44 secures the gas tube 16 and end plug 30 to the carrier block 44 via the alignment of cross bores 40 and openings 42.

The forward/aft position of the carrier bock 44 and, thus, of the gas tube 16, is adjusted by threaded engagement with an adjustment screw 48 situated inside an offset, threaded longitudinal opening 50. The adjustment screw 48 is seated in a guide notch 58 and captured between forward and rear walls 52, 54 of a niche 56 in the gas block body 26. The adjustment screw 48 may be oriented substantially parallel to the secondary bore 34 and gas tube 16 and can be rotated in any suitable manner, including manually. In the illustrated embodiment, the adjustment screw 48 can be rotated by a tool (not shown), such as a screwdriver or hex wrench. Because the adjustment screw 48 is substantially captive against longitudinal movement, rotation causes the carrier block 44 to move forward and aft, moving the gas tube 16 longitudinally with it. The secondary bore 34, including in the front wall 52, can act as a guide for the longitudinal sliding movement of the gas tube 16. If desired, the screw 48 can have discrete rotational positions and held against unintended rotation by interaction of a detent 60 biased by a spring 62 (positioned in a blind end cross bore 64) against longitudinal groves 66 formed in the exterior threads of the adjustment screw 48.

Figure 6:
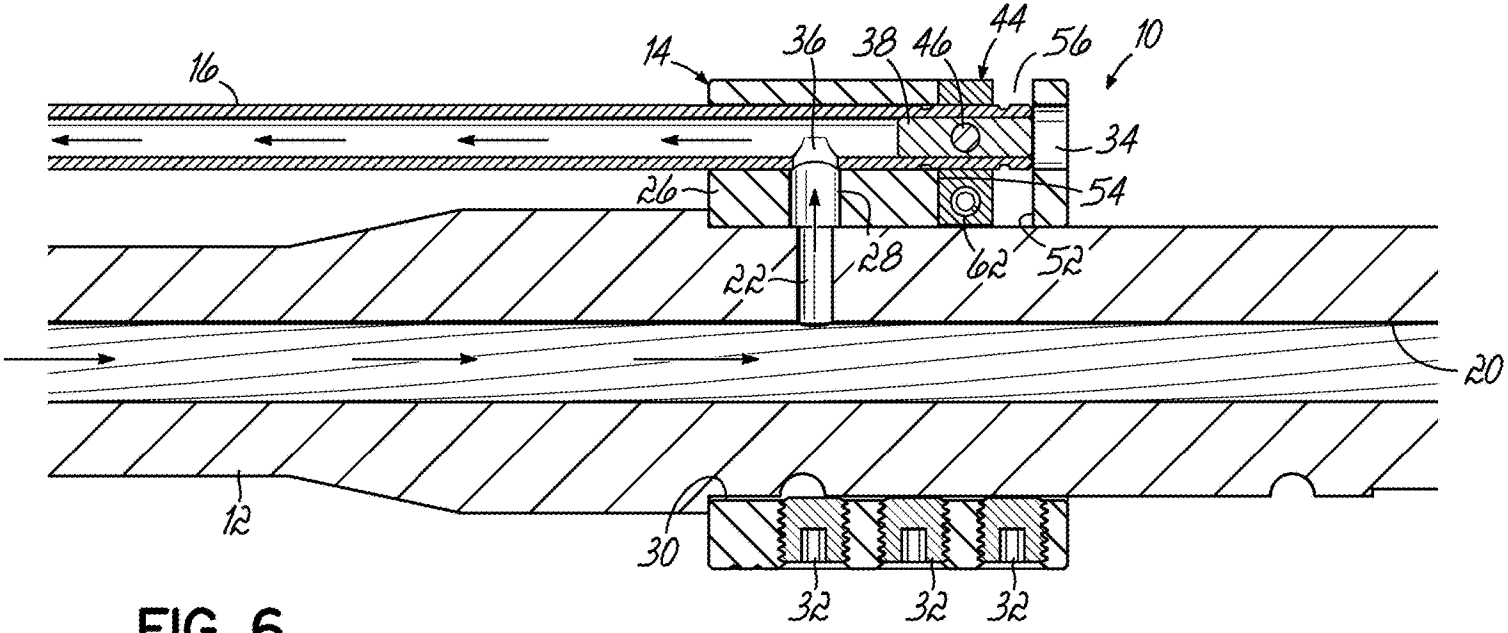
FIG. 6 is a first fragmentary side sectional view of the gas block showing the gas tube in a first position.
Figure 8:
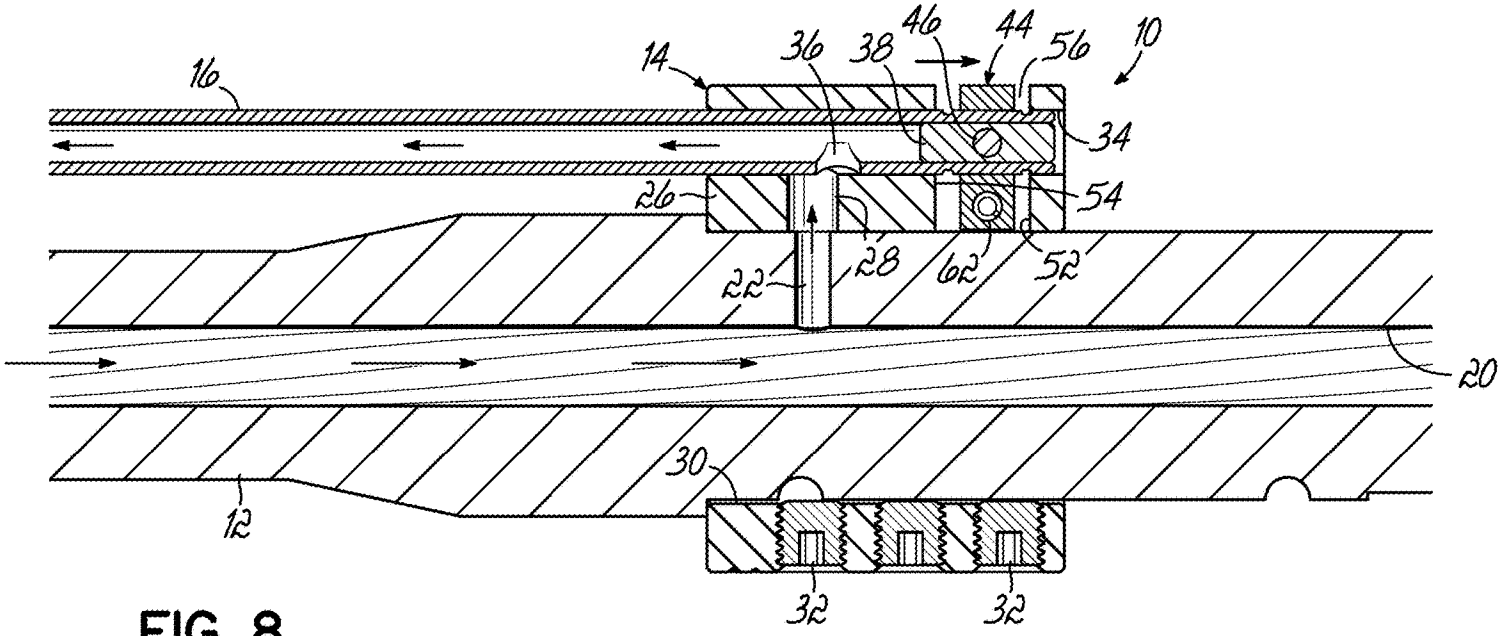
FIG. 8 is a second fragmentary side sectional view of the gas block showing the gas tube adjusted to a second position.

As previously described, gas pressure flows from the barrel bore 20, through a radial barrel port 22 and the gas block passageway 28 to the gas tube inlet 36. For full gas flow, the inlet 36 is fully aligned with the gas block passageway 28, as illustrated in FIG. 6. As the carrier block 44 and gas tube 16 are moved, the gas tube inlet 36 is be moved to or from alignment and disalignment with the gas block passageway 28, changing the gas flow orifice size. As shown in FIG. 8, when the gas tube 16 is shifted forward, the inlet is at least partially disaligned with the gas passageway 28, reducing the gas flow orifice size and, thereby, reducing the gas flow.

Figure 7:
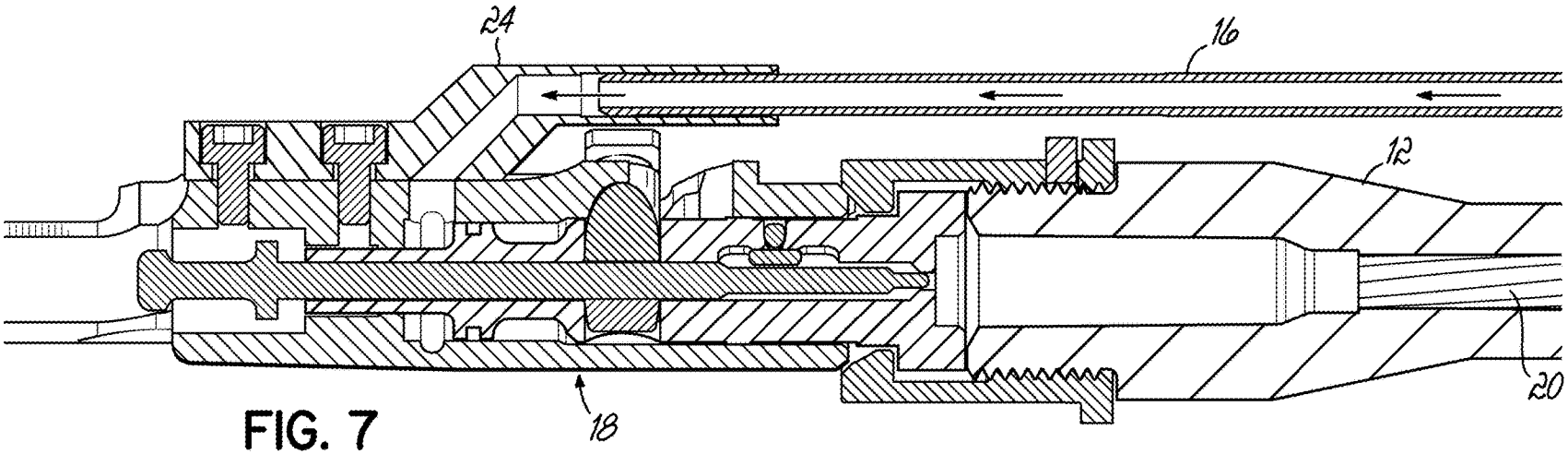
FIG. 7 is a first fragmentary side sectional view of the bolt carrier group showing the gas tube in a first position.
Figure 9:
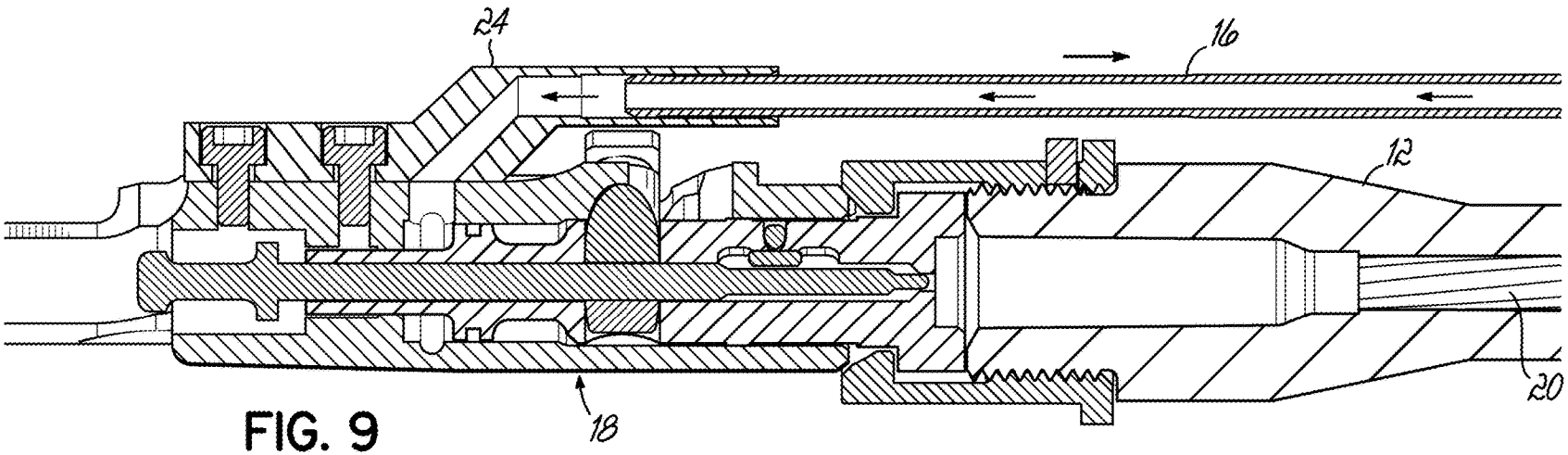
FIG. 9 is a second fragmentary side sectional view of the bolt carrier group showing the gas tube adjusted to a second position.

As shown by a comparison of FIGS. 7 and 9, the rear end position of the gas tube 16 that engages in and provides gas communication with the gas key 24 of the bolt carrier 18 also shifts. The standard, fully open gas flow position of the gas tube 16 is illustrated in FIGS. 6 and 7. Adjustment of the gas tube 16 to reduce gas flow moves it slightly forward, as shown in FIGS. 8 and 9. The change in the rear end position of the gas tube 16 (at any adjustment setting) maintains engagement with the gas key 24 and the slight change in position has negligible (if any) effect on the operation of the gas system 10.

While one or more embodiments of the present invention have been described in detail, it should be apparent that modifications and variations thereto are possible, all of which fall within the true spirit and scope of the invention. For example, the invention is not limited to an AR-pattern firearm nor to the gas tube being positioned above the barrel. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims, interpreted according to the tenants of claim construction, including the doctrine of equivalents.

What is claimed is:

1. A firearm gas system, comprising:

a gas block having a body with a gas passageway for alignment with a barrel gas port;

a gas tube having a gas inlet in a forward portion thereof, the gas tube being axially slidable within the body to adjust position of the gas inlet relative to the gas passageway to thereby adjust gas flow when the gas tube is arranged in the body, wherein the gas inlet is axially variably positionable relative to the gas passageway to either align or at least partially disalign the gas inlet relative to the gas passageway; and a threaded adjustment screw configured to cause axial translation of the gas tube relative to the body upon rotation of the threaded adjustment screw, wherein the threaded adjustment screw is seated on the gas block and the gas block is configured to inhibit longitudinal movement of the threaded adjustment screw while permitting rotation of the threaded adjustment screw.

2. The gas system of claim 1, further comprising a detent to retain the threaded adjustment screw in discrete incremental rotational positions.

3. The gas system of claim 1, wherein the threaded adjustment screw is axially offset from the gas tube.

4. The gas system of claim 1, wherein the gas inlet is located in a sidewall of the gas tube.

5. The gas system of claim 4, wherein the gas inlet is oriented downward.

6. The gas system of claim 1, further comprising a gas tube carrier block attached to the forward portion of the gas tube and configured to move the gas tube relative to the body.

7. The gas system of claim 6, wherein the threaded adjustment screw is configured to adjust the position of the gas tube carrier block relative to the body.

8. The gas system of claim 7, further comprising a detent to retain the threaded adjustment screw at discrete rotational positions.

9. The gas system of claim 6, wherein the body includes forward and rearward walls with a space between to receive the gas tube carrier block.

10. The gas system of claim 9, wherein gas tube acts as a guide for the carrier block.

11. The gas system of claim 6, wherein the gas inlet in the gas tube is fully aligned with the gas passageway of the gas block when the carrier block is in contact with the rear wall, and wherein the gas inlet in the gas tube is at least partially disaligned with the gas passageway when the gas block moves towards the forward wall.

12. The gas system of claim 11, wherein gas tube acts as a guide for the carrier block.

13. A semiautomatic, gas operated firearm, comprising:

a receiver;

a barrel having a longitudinal bore and a barrel gas port;

a gas block having a body with gas passageway for alignment with a barrel gas port;

a gas tube having a gas inlet in a forward portion thereof, the gas tube being slidable within the body to adjust position of the gas inlet relative to the gas passageway to thereby adjust gas flow when the gas tube is arranged in the body, wherein the gas inlet is axially variably positionable relative to the gas passageway to either align or at least partially disalign the gas inlet relative to the gas passageway; and a threaded adjustment screw configured to cause axial translation of the gas tube relative to the body upon rotation of the threaded adjustment screw, wherein the threaded adjustment screw is seated on the gas block and the gas block is configured to inhibit longitudinal movement of the threaded adjustment screw while permitting rotation of the threaded adjustment screw.

14. The gas system of claim 13, further comprising a detent to retain the threaded adjustment screw in discrete incremental rotational positions.

15. The gas system of claim 13, wherein the threaded adjustment screw is axially offset from the gas tube.

16. The gas system of claim 13, wherein the gas inlet is located in a sidewall of the gas tube.

17. The gas system of claim 16, wherein the gas inlet is oriented downward.

18. The gas system of claim 13, further comprising a gas tube carrier block attached to a forward portion of the gas tube and configured to move the gas tube relative to the body.

19. The gas system of claim 18, wherein the threaded adjustment screw is configured to adjust the position of the gas tube carrier block relative to the body.

20. The gas system of claim 19, further comprising a detent to retain the threaded adjustment screw at discrete rotational positions.

21. The gas system of claim 18, wherein the body includes forward and rearward walls with a space between to receive the gas tube carrier block, and wherein the gas inlet in the gas tube is fully aligned with the gas passageway of the gas block when the carrier block is in contact with the rear wall, and wherein the gas inlet in the gas tube is at least partially disaligned with the gas passageway when the gas block moves towards the forward wall.

* * * * *